United States Patent [19]

Riley

[11] Patent Number: 4,586,114

[45] Date of Patent: Apr. 29, 1986

[54] NIGHT-HUNTING METHOD AND APPARATUS

[76] Inventor: N. D. Riley, Rte. 4, Box 49, Union City, Tenn. 38261

[21] Appl. No.: 660,031

[22] Filed: Oct. 12, 1984

[51] Int. Cl.[4] ..... F41G 1/34; F41C 27/00

[52] U.S. Cl. ..... 362/191; 42/90; 43/1; 43/124; 248/201; 248/DIG. 12; 362/106; 362/110; 362/190; 362/208; 362/253

[58] Field of Search ..... 362/110, 190, 105, 106, 362/208, 108, 253, 191; 43/1, 124; 42/90; 248/201, DIG. 12

[56] References Cited

U.S. PATENT DOCUMENTS

| | | | |
|---|---|---|---|
| 786,227 | 3/1905 | Logan et al. | 362/110 |
| 1,470,432 | 10/1923 | Evans | 362/108 |
| 1,923,531 | 8/1933 | De Florez | 362/113 |
| 2,101,479 | 12/1937 | Schenk | 362/184 |
| 2,128,526 | 8/1938 | Eslick | 362/282 |
| 2,447,892 | 8/1948 | Baliff | 362/396 |
| 2,529,057 | 11/1950 | Teffault | 33/241 |
| 2,657,303 | 6/1951 | Dickens | 362/191 |
| 2,912,566 | 3/1957 | Cornet | 362/110 |
| 3,739,167 | 6/1973 | Avery | 362/157 |
| 4,000,403 | 12/1976 | Rice | 362/110 |
| 4,069,414 | 1/1978 | Bell | 362/110 |
| 4,199,802 | 4/1980 | Malm | 362/106 |
| 4,298,913 | 11/1981 | Lozar | 362/108 |
| 4,319,309 | 3/1982 | Benoit | 362/108 |

*Primary Examiner*—Stephen J. Lechert, Jr.
*Assistant Examiner*—Howard J. Locker
*Attorney, Agent, or Firm*—Lane and Aitken

[57] ABSTRACT

A hunting light adapted to be carried by a hunter, the light including lamp means for providing night-hunting illumination, a portable power source adapted to be worn by the hunter, the power source connected to the lamp means, and bracket means affixed to the lamp for releasably attaching the lamp to the hunter's weapon so that the lamp can also be hand held or worn by the hunter while hunting. In one embodiment, a second bracket means is adapted to be worn by the hunter, whereby the lamp can be releasably attached to the second bracket means and thus worn by the hunter when it is not attached to the hunter's weapon. A method of providing illumination for hunting at night is also described.

11 Claims, 4 Drawing Figures

10
12
14
16
18
20
22
24
26
27
28
30
32
34
36
38
A

NIGHT-HUNTING METHOD AND APPARATUS

BACKGROUND OF THE INVENTION

1. Field of the Invention

The present invention relates to hunting methods and accessories. More specifically, the present invention relates to lighting used by hunters at night.

2. Discussion of the Prior Art

Night hunting for raccoon and other game animals is a challenging sport that presents it own peculiar set of problems. Foremost among them is the problem of lighting. Gun-mounted lights both for aiming and for general illumination are known in the art. Such devices include the spot lights and the sight light disclosed in U.S. Pat. No. 3,739,167 and U.S. Pat. Nos. 2,128,526 and 4,069,414, respectively. The sight light disclosed by the '526 patent is noteworthy in that it can be detached to permit the gun to be used without it when the gun is used in lighted areas. This light is not adapted to be hand held, however, nor are other means for carrying or directing this light disclosed by the '526 patent.

The gun-mounted lights are advantageous in that they provide control of the direction of the light while both of the hunter's hands are busy aiming the gun. Since they are fixed to the gun, however, the hunter must aim the gun to aim the light. That combination of gun and light is heavy and very awkward, like having a flashlight more than two feet long. Further, as a matter of policy, having the hunter unable to aim the light without aiming the gun in the same direction is a hazardous arrangement.

SUMMARY OF THE INVENTION

A hunting light in accordance with the present invention comprises lamp means for providing night-hunting illumination that is connected to a portable power source, both of which are adapted to be carried by the hunter. The lamp is affixed to a bracket that is adapted to releasably secure the lamp to the hunter's weapon so that the hunter can, alternatively, wear or hand carry the lamp.

BRIEF DESCRIPTION OF THE DRAWINGS

The objects, features and advantages of the present invention will be more fully appreciated when taken in conjunction with the following detailed description and the accompanying drawings wherein.

In these figures similar parts have the same reference numeral.

DESCRIPTION OF A PREFERRED EMBODIMENT

Figures 1, 2, 3, 3A:
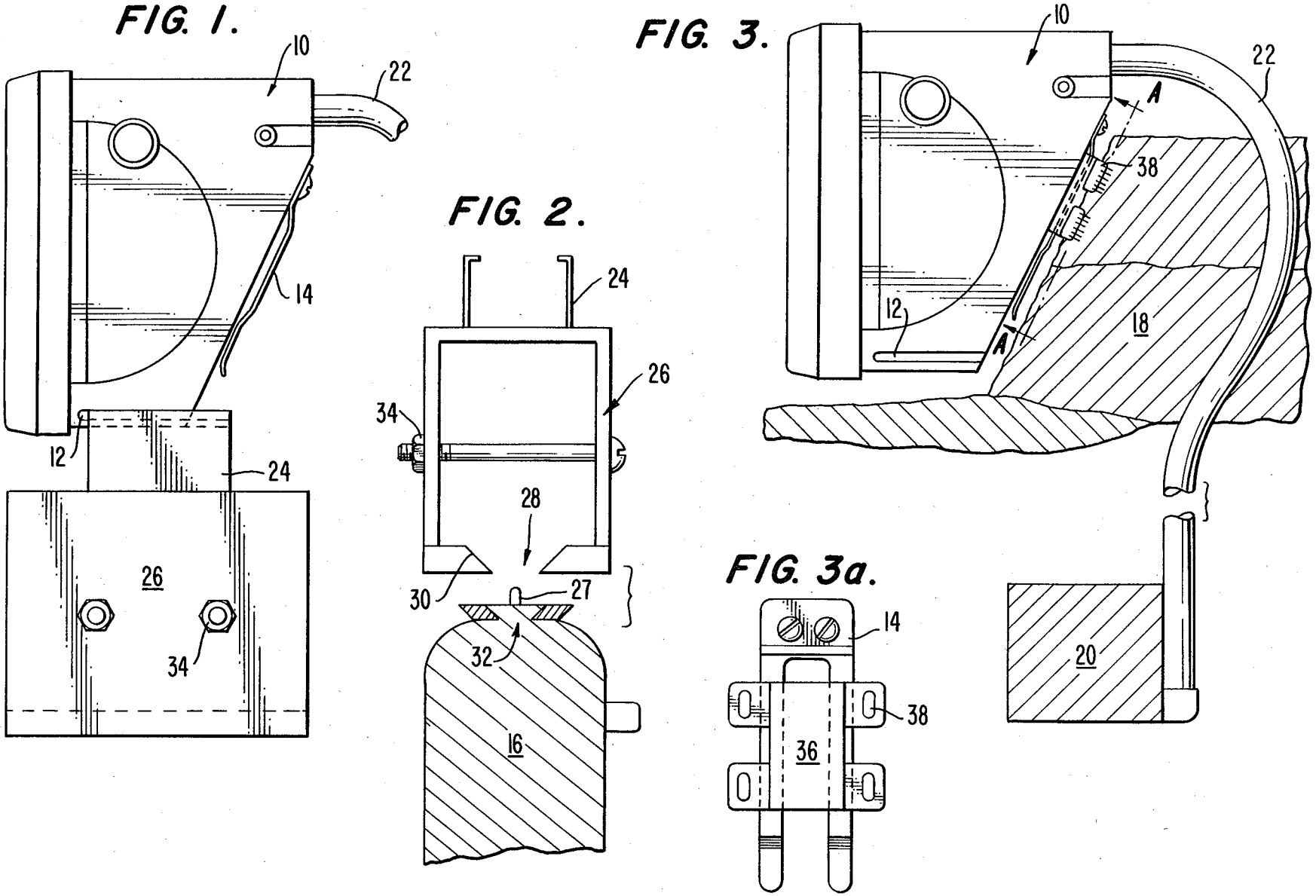
FIG. 1 is a side view of a hunting light in accordance with a preferred embodiment of the present invention.
FIG. 2 is a cross-section view of the present invention.
FIG. 3 is a side view of the hunting light of FIG. 1 mounted on a hunting cap.
FIG. 3*a* is a cross-section detail of FIG. 3 taken at "A".

In the preferred embodiment shown in FIG. 1, a spotlight 10 suitable for use while hunting raccoon at night, such as the "Wheat Light" manufactured by the Koehler Wheat Company, is provided. The light has, at the lower end of each side surface, a slot 12 and, at the center of its rear surface, a clip 14, the slots and the clip being provided for attaching the lamp 10 to a hunter's gun 16, shown in FIG. 2, or to some article of clothing, such as a hunting cap 18, shown in FIG. 3. The lamp is powered by a portable battery pack 20 carried in the hunter's jacket pocket and connected by a flexible weather-proof cable 22 to the lamp 10.

In FIG. 1, a bracket 24 on the upper surface of an adapter clamp 26 is slideably engaged in the slot 12 on either side of the lamp 10. The adapter clamp 26 and the bracket 24 thereon are formed of a single piece of extruded aluminum. The adapter clamp 26 raises the lamp 10 above the gun 16 to avoid blocking the hunter's sight line over the gun sight when the gun is aimed.

A wedge-shaped notch 28 is cut between the legs of the adapter clamp 26. The edges of the notch 28 are also bevelled 30 to fit the notch 28 to a dovetail 32 on the barrel of the gun 16, as illustrated in FIG. 2. This dovetail is commonly provided on hunting guns for attaching a telescopic sight. The adapter clamp 26 is affixed to the dovetail 32 by tightening a pair of transverse bolts 34. The lamp 10 is only held in the bracket 24, however, by a slight friction and, so, it can be easily slid out of the slot 12 with one hand and hand held. Although the lamp is securely attached to the clamp 26, it is adapted to be removed from the gun when the hunter is not aiming the gun, to provide greater freedom of movement for the light while the hunter searches for game. The light's attachment to the gun, thus, is temporary.

To free a hunter's hands while allowing greater flexibility of light movement in searching for game, the lamp can be temporarily attached to the hunter's cap 18, as shown in FIG. 3, instead of to the gun 16. In this position the light will be directed so as to illuninate whatever the hunter is looking at. However this is also only a temporary position, one for carrying the lamp while hunting at night. While the hunter is aiming the gun, a light affixed to the hunter's cap in a position that was appropriate while searching for game will be misdirected, thus decreasing visibility at the crucial movement when the gun is aimed and fired. To provide quick mounting and quick release the lamp 10 is fastened to the cap 18 by the spring clip 14 which slides into a pair of grooves, one on either side of a complementary bracket 36 that is sewn onto the center front of the cap 18 through four eyelets 38.

Of course, the preferred embodiment described and illustrated herein is provided for the purpose of explaining the invention. The invention is not limited thereby. Many variations and modifications are possible within the spirit and scope of this invention. For example, the light may provide a sight beam as well as general illumination and therefore be mounted directly on the dovetail without an adapter clamp; or the light may be clamped onto the gun without using the dovetail; or the lamp may be attached to the cap or some other article of clothing with a hook or another suitable fastener.

I claim:

1. A hunting light adapted to be carried by a hunter, said light comprising:

lamp means for providing night-hunting illumination, said lamp means being shaped to be conveniently used as a hand held lamp;

a portable power source adapted to be worn by the hunter, said power source connected to said lamp means; and lamp bracket means affixed to said lamp means for releasably attaching said lamp to a dovetail on the hunter's weapon so that the lamp provides light for aiming said weapon and can also be hand held or worn by the hunter while hunting, said lamp bracket means shaped to provide one-handed quick mounting and quick release of the lamp means from the weapon.

2. A hunting light adapted to be carried by the hunter as claimed in claim 1, said light further comprising an attachment bracket that is interposed between said lamp bracket and said dovetail, said attachment bracket including an adapter clamp having legs shaped to cooperate with the dovetail on the hunter's weapon for mounting said adapter clamp on the weapon and adjustment means for fixedly attaching said adapter clamp to the weapon by tightening said legs against the weapon, said attachment bracket also including holding means permanently attached to said adapter clamp for providing a quick mounting and quick release of said lamp means, said holding means holding said lamp means in a position such that said lamp means does not interfere with the hunter's sight line for aiming the weapon.

3. The hunting light as claimed in claim 2 wherein said lamp bracket means comprises a slot slideably engaging said attachment bracket.

4. A hunting light and attachment means adapted to be carried by a hunter, said light comprising:

lamp means for providing night-hunting illumination;

a portable power source adapted to be carried by the hunter, said power source connected to said lamp means;

attachment bracket means adapted to be affixed to the hunter's weapon said first bracket means including an adapter clamp having legs shaped to cooperate with the hunter's weapon for mounting said adapter clamp on said weapon, and adjustment means for fixedly attaching said adapter clamp to the weapon by tightening said legs against the weapon, said attachment bracket means also including holding means for providing quick mounting and quick release of said lamp means, said holding means being permanently affixed to said adapter clamp;

carrying bracket means adapted to be worn by the hunter;

lamp bracket means affixed to said lamp means for releasably attaching said lamp means to said attachment and carrying bracket means, respectively, so that the lamp means can, alternatively, be attached to said weapon to provide light for aiming said weapon or worn by the hunter, said lamp bracket means being shaped to provide one-handed quick mounting and quick release of said lamp means in cooperation with said attachment and carrying bracket means.

5. The apparatus as claimed in claim 4 wherein said second bracket means is sewn onto the hunter's cap.

6. The hunting light as claimed in claim 4 wherein said lamp bracket means comprises a spring-loaded clip for engaging said carrying bracket means.

7. A method of providing illumination for hunting at night comprising the steps of:

attaching a hunting lamp to a first quick-mounting and quick-release bracket means worn by the hunter;

illuminating an area in which a hunted animal is located while the lamp is attached to said first bracket detaching said lamp from said first bracket means;

attaching said lamp to the hunter's weapon using a second quick-mounting and quick-release bracket means; and sighting said animal with said weapon.

8. The method of claim 7 further comprising the step of causing said lamp to provide a sight beam when it is attached to said first bracket means, wherein said sighting step comprises sighting said animal with said sight beam.

9. The method of claim 7 further comprising the step of locating the hunted animal with the lamp after detaching the lamp from the first bracket means and before attaching the lamp to the second bracket means.

10. An attachment bracket for use with a hunter's weapon and hunting lamp, said attachment bracket comprising:

an adapter clamp having two legs shaped to cooperate with the weapon for mounting said adapter clamp thereon and adjustment means for fixedly attaching said adapter clamp to the weapon by tightening said legs against the weapon; and holding means for providing one-handed quick mounting and quick release of the lamp, said holding means being permanently affixed to said adapter clamp, said holding means being shaped to cooperate with the lamp to provide light for aiming the weapon and one-handed quick mounting and quick release of the lamp from the weapon while said adapter clamp is fixedly attached to the weapon, said attachment bracket being shaped to hold the lamp in a position such that said lamp and said bracket do not interfere with the hunter's sight line for aiming the weapon.

11. The attachment bracket as claimed in claim 10 wherein said adapter clamp is beveled to cooperate with a dovetail on a hunter's weapon to secure the adapter clamp to said dovetail on the hunter's weapon.

* * * * *